US006573019B1

(12) United States Patent
Van den Zegel et al.

(10) Patent No.: US 6,573,019 B1
(45) Date of Patent: Jun. 3, 2003

(54) PHOTOGRAPHIC SILVER HALIDE PHOTOGRAPHIC MATERIAL FOR MAMMOGRAPHY

(75) Inventors: Marc Van den Zegel, Boortmeerbeek (BE); Francis Vanhoudt, Edegem (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 10/100,102

(22) Filed: Mar. 18, 2002

Related U.S. Application Data

(60) Provisional application No. 60/292,041, filed on May 18, 2001.

(30) Foreign Application Priority Data

Mar. 29, 2001 (EP) ..... 01000090

(51) Int. Cl.[7] ..... G03C 5/16

(52) U.S. Cl. ..... 430/139; 430/502; 430/507; 430/567; 430/966

(58) Field of Search ..... 430/502, 139, 430/567, 966, 507

(56) References Cited

U.S. PATENT DOCUMENTS 6,037,112 A * 3/2000 Dickerson ..... 430/502

FOREIGN PATENT DOCUMENTS

EP 0 384 633 A 8/1990
EP 0 440 367 A 8/1991
EP 0 874 275 A 10/1998

* cited by examiner

*Primary Examiner*—Thorl Chea
(74) *Attorney, Agent, or Firm*—Joseph T. Guy; Nexsen Pruet Jacobs & Pollard, LLC

(57) ABSTRACT

A radiographic film material has been described for recording medical diagnostic images of soft tissue through exposure to light, emitted by a single intensifying screen, after having been subjecting to exposure with X-rays, emitted from an X-ray generating device with a tube voltage of 20 kV to 40 kV, and processing, including development, fixing and drying, within a time of 120 (and more preferably 90) seconds or less, wherein said film is comprised of a transparent film support, front and back major faces and an image-forming portion for providing, when imagewise exposed by light emitted by said intensifying screen and processed, an average contrast or gradient in the range from 3.0 up to 4.5, measured over a density above fog in the range of from 0.25 to 2.00, and wherein said image-forming portion is comprised of layer units permeable for aqueous processing solutions, said layer units being a hydrophilic front layer unit coated on the said front major face of the support wherein the front layer unit is capable of reaching a maximum density of more than 3.00; a hydrophilic back layer unit coated on the said back major face of the support; wherein sensitivity (speed), measured at a density of 0.50 above fog, is higher for the front layer unit than for the back layer unit in an amount of from 0.70 up to 1.70 log (Exposure); characterized in that both the front layer unit and the back layer unit have one or more light-sensitive silver halide emulsion layer(s) coated with emulsion crystals, essentially having a cubic crystal habit.

10 Claims, No Drawings

PHOTOGRAPHIC SILVER HALIDE PHOTOGRAPHIC MATERIAL FOR MAMMOGRAPHY

This application claims the benefit of provisional application No. 60/292,041, filed May 18, 2001.

BACKGROUND OF THE INVENTION

The incidence of breast cancer carcinoma among women continues to increase, posing a serious health problem throughout the world. The mortality rate from breast cancer can be decreased significantly by early detection using the radiological mammography technique. With this technique the compressed breast is irradiated with soft X-rays emitted from an X-ray generating device and modulated X-rays are detected with a radiographic X-ray conversion screen, also called intensifying screen, fluorescent screen or phosphor screen. The X-ray conversion screen comprises a luminescent phosphor which converts the absorbed X-rays into visible light and the emitted visible light exposes a silver halide film that is brought into contact with said X-ray conversion screen. After film processing, comprising the steps of developing, fixing, rinsing and drying, a mammogram is obtained which can be read on a light box.

No other field of medical radiology demands such a high level of image quality as mammography and the ability of the mammogram to portray relevant diagnostic information is highly determined by the image quality of the screen-film system. Image quality is manifested by a number of features in the image including sharpness, noise, contrast, silver image color and skin line perceptibility. It is common practice to set the amount of X-ray exposure so that the tissues on the inside of the breast are depicted at medium optical density values, i.e. in the optical density range from [Dmin+1.0] to [Dmin+2.5], Dmin being defined as the [base+fog]-density obtained after processing the unexposed film, and the diagnostic perceptibility of small, potentially malignant lesions in these tissues is highly determined by the contrast of the mammography film within said density range. A quantitative measure of the film contrast is the so-called average gradation, defined as the slope of the line drawn by connecting both points of the sensitometric curve of optical density vs. logarithmic exposure at which the optical density is equal to [Dmin+1.0] and [Dmin+2.5].

Conventional mammography films can roughly be classified in low and high contrast types according to the value of their average gradation as defined above. The low contrast type can be characterized by a relatively low average gradation ranging from 2.0 to 2.5, whereas the average gradation of the high contrast type may range from 3.0 to 3.5. Often, high contrast films are preferred because of the higher ability to detect tiny cancers deep in the glandular tissue of the breast. If the contrast is too high, however, it may preclude visualization of both thin (i.e. the skin line) and thick tissues (i.e. the inside of the breast) in the same image due to lack of exposure latitude. Therefore, some radiologists prefer low contrast mammography films. When the contrast is low, skin line perceptibility is excellent, but then the chance of missing possibly malignant breast lesions is high. Thus a balance has to be found between contrast and exposure latitude and an example of this approach is described in U.S. Pat. No. 5,290,665.

In order to extend the exposure latitude some manufacturers have introduced high contrast mammography films characterized by a higher maximum density (hereinafter referred to as Dmax) than conventional high contrast films, e.g. a Dmax equal to at least 3.7, preferably even higher than 4.0. However, a film characterized by a higher "Dmax" is only a minor improvement with regard to better skin line perceptibility, since the background density is too high for the skin line to be clearly visible. Indeed at optical density values above 3.5, the local gradient, i.e. the slope of the sensitometric curve, must be very high in order to guarantee a reasonable perceptibility as described in the well-known article titled "Determination of optimum film density range for röntgenograms from visual effect" by H. Kanamori (Acta Radiol. Diagn. Vol.4, p. 463, 1966). Nevertheless, processed mammography films showing a higher maxmum density are appreciated by a growing number of radiologists because of the wider dynamic range, i.e., the density range [Dmax–Dmin] of the mammogram.

To summarize: it remains difficult to obtain mammograms with high contrast and high maximum density, moreover clearly depicting thin tissue such as the skin line of the breast. Some improvements have been obtained by modifying the X-ray generating device, such as the scanning mammography system described in U.S. Pat. No. 5,164,976. These solutions however require the replacement of the conventional X-ray apparatus by a completely new system with a much higher technical complexity. Maintaining the image quality constant is becoming another requirement of facilities performing mammography. Accordingly, quality control tests are executed on a regular basis in order to monitor the consistency of the performance of the X-ray equipment, the image receptors and the film processor. To minimize the influence of varying film processing time, temperature, chemistry and replenishment, a preferred mammography film requires a stable speed and contrast with respect to these processing parameters.

In addition, there is a general trend in the field of radiology to shorten the film processing time and likewise in the field of mammography, the interest has focused on rapid access of mammograms.

As a consequence mammography films are preferred which comprise silver halide crystals that can be processed rapidly and consistently in a dry-to-dry processing cycle of 90 seconds or less and therefore, most mammography films today comprise good developable cubic silver halide crystals. As described in EP-A 0 712 036, such cubic crystals show a stable speed and contrast upon varying processing parameters. Cubic emulsions however are characterized by a very high contrast, resulting in a poor skin line perceptibility. On the other hand tabular silver halide emulsion crystals, also being rapidly processable, are characterized by a much lower contrast than cubic silver halide emulsions and thus are only applicable for manufacturing low contrast mammography films. Another drawback of these tabular emulsions is the residual color after processing: due to the larger specific area of the tabular grains compared e.g. with cubic crystals having the same crystal volume, these tabular grains require higher amounts of spectrally sensitizing dye (s), which may leave dye stain after the short processing cycle. Also the brownish color of the developed silver image of thin tabular grains, resulting in an undesired image tone, is a disadvantage for mammography making use of the said tabular grains.

Nowadays most of the single-side coated film materials for mammography have an amount of coated silver halide, expressed as an equivalent amount of silver nitrate, in the range from 6.0 up to less than 8.5 g/m$^2$. A disadvantage related with such high coating amounts is the presence of high amounts of coated gelatin, present as protective colloid of the silver halide crystals and as hydrophilic binder of the coated layers, which results in absorption of high amounts of water at one side of the support and long drying times in the processing. A high pressure sensitivity as coated minimum amounts of hydrophilic colloidal binder are envisaged on one hand and questionable archivability as a consequence of long fixing times, shortened in order to provide ending processing within shortened rapid processing cycles at the other hand, clearly lay burden on the most critical feature in mammography, being "image quality", and more particularly "sharpness".

As mammographic and similar soft tissue imaging medical diagnostic films are coated in a single-sided format in order to maximize image sharpness and uniformity, higher rates of rapid access processing finding increasing use in processing dual-coated radiographic films are questionable. A first attempt has been made by Luckey et al, U.S. Pat. No. 4,710,637 in order to provide mammographic film in dual-coated format. However this film was ultimately rejected by radiologists as failing to provide images of acceptably high sharpness and low mottle. No medical diagnostic radiographic film for imaging soft tissue, such as mammographic film, has heretofore been available combining high levels of image sharpness and uniformity and the capability of accelerated rates of rapid access processing attainable with dual-coated radiographic films. Another attempt has been made in U.S. Pat. No. 5,759,754, wherein it was a purpose to maintain acceptably high levels of image sharpness and low levels of mottle. In one aspect that invention was directed to a radiographic film for recording medical diagnostic images of soft tissue through (a) exposure by a single intensifying screen located to receive an image bearing source of X-radiation and (b) processing, including development, fixing and drying, in 90 seconds or less comprised of a transparent film support (transparent to radiation emitted by the intensifying screen) and having opposed front and back major faces and an image-forming portion for providing, when imagewise exposed by the intensifying screen and processed, an average contrast in the range of from 2.5 to 3.5, measured over a density above fog of from 0.25 to 2.5, wherein the image-forming portion is comprised of (i) a processing solution permeable front layer unit coated on the front major face of the support capable of absorbing up to 60 percent of the exposing radiation and containing less than 3 $g/m^2$ of hydrophilic colloid and less than 3 $g/m^2$ silver in form of radiation-sensitive silver halide grains, and (ii) a processing solution permeable back layer unit coated on the back major face of the support containing less than 4 $g/m^2$ of hydrophilic colloid, silver in the form of radiation-sensitive silver halide grains accounting for from 40 to 60 percent of the total radiation-sensitive silver halide present in the film, and a dye capable of providing an optical density of at most 0.40 in the wavelength region of the exposing radiation intended to be recorded and an optical density of less than 0.1 in the visible spectrum at the conclusion of film processing. In a preferred embodiment said radiation-sensitive silver halide grains in the front and back layer units were provided by a tabular grain silver halide emulsion containing more than 70 mole % of bromide and less than 4 mole % of iodide, based on the total amount of silver present. Another attempt has been proposed in U.S. Pat. No. 6,037,112 wherein part of the density of the exposed film after processing, more particularly in the high-density region, has been built-up by silver, generated by reducing thin tabular silver halide emulsion crystals, coated in the backing layer. Said tabular grains or crystals having an average thickness of less than 0.3 $\mu$m and an average aspect ratio of more than 5:1 provide high covering power. Apart from the resulting brownish-red color of the processed thin tabular grains, which is clearly observed in reflectance, the morphological difference between cubic crystals at the front side of the support, exposed in contact with the intensifying screen, and the thin tabular grains present at the side of the backing layer, lays burden on sensitometrical consistency when making use of developer and fixer solutions having differing or varying compositions.

SUMMARY OF THE INVENTION

It is therefore a first object of the present invention to provide a photographic material for mammography which is not only characterized by a high diagnostic quality, a large dynamic range and a high contrast so that small lesions deep in the glandular tissue are accurately detected without disturbing sites or strikes, present as a consequence of pressure sensitivity of the coated silver halide emulsion crystals, but which moreover clearly depicts thin tissue such as the skin line of the breast.

It is another object of the present invention to provide a photographic material comprising silver halide emulsion crystals which are rapidly processable, more particularly with respect to a reduced drying time, and to provide a neutral silver image color without leaving residual sensitizing dye after processing.

It is still another object of the present invention to guarantee perfect archivability of the images obtained, by complete fixation of the processed image within a short processing time cycle of at most 120 seconds, and, more preferably, within a time cycle of 90 seconds dry-to-dry.

It is even a further object of the present invention to provide a radiological method using the photographic material according to the present invention for obtaining a suitable diagnostic image for mammography in differing developer compositions, in that an optimized sensitometric profile is attained in strongly differing processing conditions.

Further objects and advantages of this invention, which may be obtained by specific embodiments, will become apparent from the description hereinafter.

In order to fully reach the objects of the present invention, a radiographic film material has been provided for recording medical diagnostic images of soft tissue through exposure to light, emitted by a single intensifying screen, after having been subjecting to exposure with X-rays, emitted from an X-ray generating device with a tube voltage of 20 kV to 40 kV, and processing, including development, fixing and drying, within a time of 120 seconds (and more preferably 90 seconds or less), wherein said film is comprised of a transparent film support, front and back major faces and an image-forming portion for providing, when imagewise exposed by light emitted by said intensifying screen and processed, an average contrast or gradient in the range from 3.0 up to 4.5, measured over a density above fog in the range of from 0.25 to 2.00, and wherein said image-forming portion is comprised of layer units permeable for aqueous processing solutions, said layer units being a hydrophilic front layer unit (unit more close to the intensifying screen during exposure to X-rays) coated on the said front major face of the support wherein the front layer unit is capable of reaching a maximum density of more than 3.00;

a hydrophilic back layer unit (unit farther from the intensifying screen during exposure to X-rays) coated on the said back major face of the support; wherein sensitivity (speed), measured at a density of 0.50 above fog, is higher for the front layer unit than for the back layer unit in an amount of from 0.70 up to 1.70 log (Exposure) [differences calculated before and after washing off the backing layer unit from the material, processed after exposure to X-rays of the said material, being in intimate contact with an intensifying screen at the front layer side thereof];

characterized in that both the front layer unit and the back layer unit have one or more light-sensitive silver halide emulsion layer(s) coated with emulsion crystals, essentially having a cubic crystal habit.

A process for obtaining a medical diagnostic image of soft tissue is further claimed, said process comprising the steps of mounting a radiographic film as claimed adjacent to a single intensifying screen, exposing the intensifying screen to an image pattern of X-radiation that has passed through the soft tissue to provoke light emission by the intensifying screen that imagewise exposes the radiographic film, and processing the radiographic film, including development, fixing and drying in less than 120 (and more preferably 90) seconds.

DETAILED DESCRIPTION OF THE INVENTION

As has been disclosed in the statement of the present invention a radiographic film for recording medical diagnostic images of soft tissue, and more,in particular for mammographic applications, is thus characterized by the presence, at both sides of a transparent film support, of light-sensitive silver halide emulsion layers, wherein the silver halide emulsions essentially have cubic emulsion crystals. The term "essentially cubic" is indicative for the presence, in an amount of at least 90, more preferably at least 95 and even more preferably at least 99% by number of crystals having a {100} crystal habit and thus (100) crystal faces, wherein edges may be sharp or rounded-off (e.g. due to preparation methods wherein silver solubilizing growth accelerators are used such as ammonia or methionine, a thioether compound, thazolidine-2-thione, tetra-substituted thiourea, potassium or ammonium rhodanide and an amine compound may be present during grain precipitation in order to adjust the average grain size) and wherein it is even not excluded that cubo-octaeders are present, provided that (111) crystal faces therein represent not more than 10%, more preferably not more than 5% and even more preferably not more than 1% of the total projective area of all crystal faces present, and wherein (100) faces are clearly representing the majority of the crystal faces present in the emulsions. The class of so-called cubic grains embraces (a) perfectly cubic crystals, or (b) cubic crystals with rounded corners, or (c) cubic crystals with small (111) faces at the corners (also known as tetradecahedrical grains), the total area of these (111) faces however being small compared to the total area of the (100) faces. Presence of cubo-octahedral shapes which are not excluded depends on the pAg values applied during the precipitation. So preferred methods for the precipitation of cubic grains are the pAg-balanced double- or triple-jet methods as described in EP-A's 0 712 036 and 0 610 609, since these methods provide monodispersed emulsions characterized by a narrow grain size distribution defined in that at least 95% by weight or number of the grains have a diameter within about 40%, preferably within about 30% of the average grain size and more preferably within about 10% to 20%. The variation coefficient of the emulsion grains according to this invention has preferably a low value of between 0.15 and 0.20, and still more preferably of 0.10, said variation coefficient being defined as the ratio between the standard deviation of the grain size and the average grain size. This is particularly desired as a high contrast is envisaged for the mammographic image after processing of the material according to the present invention. The silver halide grains are obtained by conventional precipitation techniques which are well known in the art and consist of the addition of aqueous solutions of silver and halide salts, e.g. silver nitrate and sodium, potassium or ammonium halide to a solution comprising a protective colloid. In order to get controlled growth use is often made of variable flow rates in order to provide (and controll) crystal growth to be performed at a higher rate and to perform precipitation in more concentrated reaction vessels which may even lead to variability coefficients over the grain distributions in the range from 0.10 up to 0.20. It may however be recommended, in favor of fine-tuning desired gradations at differing densities or sensitivity points of the sensitometric curve, to have a broader emulsion grain distribution. Apart for growing the cubes in a reaction vessel at slightly higher pAg values, it is also possible and, in favor of addition of other ingredients—such as chemical and spectral sensitizers—to more uniform crystals, even recommended to prepare the most suitable cubic grain emulsion from more than one chemically and spectrally sensitized emulsion having a very narrow grain distribution. This is recommended more particularly for the light-sensitive emulsion layer in the back layer unit, which, in favor of skin line perceptibility, should contribute to the total density of the processed material, wherein the back layer unit should exhibit an optical density of at least 1.00 in the wavelength region of the exposing radiation.

The grain size of the cubic grain emulsions can be determined using conventional techniques, e.g. as described by Trivelli and Smith, The Photographic Journal, vol. 69, 1939, p.330–338, Loveland "ASTM symposium on light microscopy" 1953, p.94–122 and Mees and James "The Theory of the photographic process" (1977), Chapter II.

According to the present invention the material is coated with light (radiation)-sensitive emulsion layers having cubic emulsion grains in the front and in the back layer unit, wherein the radiation-sensitive silver halide grains are containing more than 50 mole % of silver bromide and less than 3 mole % of silver iodide, more preferably less than 2 mole % based on total molar silver amounts. In a more preferred embodiment the said radiation-sensitive silver halide grains are silver bromide or silver bromoiodide grains, containing up to at most 1 mole % of silver iodide, based on silver. Differences in silver iodide content, if present, between front and back layer units, are preferably directed to a lower iodide content in the back layer unit, in that less than 1 mole % of iodide, and more preferably about 0.5 mole % of iodide is present, based on silver. Silver iodide present in lower amounts than silver bromide can be distributed in a homogeneously (continuously) or heterogeneously (for so-called "core-shell emulsions" having a core wherein iodide concentrations are lower or higher than in the shell or shells adjacent thereto). In another embodiment pure silver bromide cubes may still be "doped" with silver iodide by application of the so-called "conversion"-technique, wherein silver iodide is formed by conversion at the grain surface after addition of organic or inorganic compounds relasing iodide ions, such as potassium iodide or the iodide releasing compounds described in EP-A's 0 563 701, 0 563 708 and 0 651 284. In still another embodiment silver iodide is added in form of ultrafine silver iodide grains of about 0.050 μm or even smaller (also called "micrate emulsions") after stopping precipitation in the precipitation method or after having ended precipitation, so that silver iodide is located at dedicated sites in the cubic grains.

Precipitation of silver halide crystals suitable for use in emulsion layers according to the present invention is performed in the presence of a protective, hydrophilic colloid, which should be chosedn with care: e.g. conventional lime-treated or acid treated gelatin can be used, but also oxidized gelatin (generally known as gelatin having less than 30 p.p.m. of methionine) or a synthetic peptizer. The preparation of such modified gelatin types has been described in e.g. "The Science and Technology of Gelatin", edited by A. G. Ward and A. Courts, Academic Press 1977, page 295 and next pages. The gelatin may also be an enzyme-treated gelatin as described in Bull. Soc. Sci. Phot. Japan, No. 16, page 30 (1966). Before and during formation of the silver halide grains it is common practice to establish a gelatin concentration of from about 0.05% to 5.0% by weight in the dispersion medium. Cubic silver halide grains may also be precipitated in absence of gelatin, e.g. by making use of colloidal silica as a protective colloid in the presence of an onium compound, as described in EP-A's 0 677 773 and 0 649 051; or in the alternative by making use of cationic oxidized starch as has been disclosed e.g. in EP-A 0 758 759.

At the end of the precipitation the emulsion is made free from excess of soluble inorganic salts by a conventional washing technique e.g. flocculation by ammonium sulphate or polystyrene sulphonate, followed by one or more washing and redispersion steps.

Conventional washing techniques can be found in Research Disclosure, Item 38957, Section III. Emulsion washing. Another well-known washing technique is ultrafiltration as described e.g. in EP-A 0 794 455. Finally, in order to prepare the emulsion for further sensitization actions extra gelatin or another binder material can be added to the emulsion in order to obtain a gelatin to silver ratio wherein the emulsion remains colloidally stable during said further actions. So in order to enhance speed of the cubic silver halide emulsion grains chemical sensitization is applied thereto according to the procedures described in e.g. "Chimie et Physique Photographique" by P. Giafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in the above mentioned literature, chemical sensitization can be carried out by effecting the ripening in the presence of small amounts of compounds containing sulphur, selenium or tellurium e.g. thiosulphate, thiocyanate, thiourea, selenosulphate, selenocyanate, selenoureas, tellurosulphate, tellurocyanate, sulphites, mercapto compounds, and rhodamines. In a preferred embodiment, these compounds or combinations thereof are applied in combination with a noble metal salt, preferably a gold complex salt, but also salts of platinum, palladium and iridium as described in U.S. Pat. No. 2,448,060 and GB-A 618,061 may be used. Description of chemical sensitization techniques can be found in Research Disclosure, Item 38957, Chapter IV. The amount of gold, used in the chemical ripening of emulsions according to the present invention, is preferably in the range of 25 to 45 p.p.m. vs. the amount of metallic silver. Additions of sulphur and/or selenium and/or tellurium and gold may be carried out consecutively or simultaneously. In the latter case the addition of goldthiosulphate, goldselenosulphate or goldtellurosulphate compounds may be recommended. Optionally, small amounts of dopants in form of complexing agents of Rh, Ru, Os, Pt or Ir, can be added if not yet performed in the course of grain precipitation in order to get grain occlusions other than silver and halide as disclosed in Research Disclosure, Item 38957, Section I; or in more general terms of transition metal hexacoordination complexes as dopants for increasing imaging speed by providing or as so-called SET's (shallow electron trapping agents as described in Research Disclosure, Vol. 367, November 1994, Item 36736. Also reductors may be added as chemical sensitizers as e.g. tin compounds as described in GB-A 789,823, amines, hydrazine derivatives, formamidine-sulphinic acids, and silane compounds. The chemical sensitization can also proceed in the presence of phenidone and/or its derivatives, a dihydroxybenzene as hydroquinone, resorcinol, catechol and/or a derivative(s) thereof, one or more stabilizer(s) or antifoggant(s), one or more spectral sensitizer(s) or combinations of said ingredients.

The silver halide emulsions may be chemically sensitized according to the procedures described in e.g. "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in the above mentioned literature, chemical sensitization can be carried out by effecting the ripening in the presence of small amounts of compounds containing sulphur,selenium or tellurium e.g. thiosulphate, thiocyanate, thiourea, selenosulphate, selenocyanate, selenoureas, tellurosulphate, tellurocyanate, sulphites, mercapto compounds, and rhodamines.

In a preferred embodiment, these compounds or combinations thereof are applied in combination with a noble metal salt, preferably a gold complex salt, but also salts of platinum, palladium and iridium as described in U.S. Pat. Nos. 2,448,060 and 5,759,760 and in GB-A 618,061 may be used. Amounts of gold, used in the chemical ripening of emulsions in order to get the most preferred contrast in the toe portion of the sensitometric curve have been disclosed e.g. in EP-A's 0 610 609 and 0 712 036. Additions of sulphur and/or selenium and/or tellurium and gold may be carried out consecutively or simultaneously. In the latter case the addition of goldthiosulphate, goldselenosulphate or goldtellurosulphate compounds may be recommended. Optionally, small amounts of compounds (complexing agents) of Rh, Ru, Os or Ir can be added. Also reductors may be added as chemical sensitizers as e.g. tin compounds as described in GB-A 789,823, amines, hydrazine derivatives, formamidine-sulphinic acids, and silane compounds. The chemical sensitization can also proceed in the presence of phenidone and/or its derivatives, a dihydroxybenzene as hydroquinone, resorcinol, catechol and/or a derivative(s) thereof, one or more stabilizer(s) or antifoggant(s), one or more spectral sensitizer(s) or combinations of said ingredients.

The silver halide grains present in a mammography film are spectrally sensitized in order to optimally detect the light emitted from the X-ray conversion screen. A preferred mammography film is characterized by a spectral sensitivity ranging from 5 to 130 $\mu J/m^2$ measured at the emission maximum of the X-ray conversion screen, said spectral sensitivity being defined herein as the amount of exposure to light of a given wavelength required to obtain an optical density Dmin+1.0 after processing. The silver halide emulsion are spectrally sensitized by adding one or several cyanine dyes, merocyanine dyes, complex, cyanine dyes, complex merocyanine dyes, hemicyanine dyes, styryl dyes and hemioxonol dyes. Preferred examples of suitable orthochromatic (J-aggregating) spectral sensitizers are 5,5'-dichloro-3,3'-bis(SO3-R)-9-ethylbenzoxacarbocyanines with R being n-propylene or n-butylene. Furthermore green-light absorbing spectral sensitizers according to the formulae given in JP-A's 06-35104, 06-35101, 06-35102, 62-191847, 63-249839, 01-312536, 03-200246, U.S. Pat. Nos. 4,777,125 and DE 3,819,241 may be used. The right choice of said sensitizers or combinations thereof is always related to the goal of attaining the highest possible photographic speed while reducing dye stain after processing. Another survey of useful chemical classes of spectral sensitizers has been given by F. M. Hamer in "The Cyanine Dyes and Related Compounds", 1964, John Wiley & Sons. A more recent disclosure has been given in EP-A 0 757 285. Techniques in order to perform optimized spectral sensitization have been described in Research Disclosures, Item 18431, Section X and Item 38957, Section V.

The silver halide grains present in a mammography film are spectrally sensitized in order to optimally detect the light emitted from the X-ray conversion screen. A preferred mammography film is characterized by a spectral sensitivity ranging from 5 to 130 $\mu J/m^2$ measured at the emission maximum of the X-ray conversion screen, said spectral sensitivity being defined herein as the amount of exposure to light of a given wavelength required to obtain an optical density Dmin+1.0 after processing.

It is clear that in the present invention the light-sensitive emulsion layers at both sides of the transparent support, which is typically a blue colored polyethylene terephtalate (PET) film having a thickness of 175 $\mu$m, are not symmetrically coated: according to the present invention the radiographic material is coated with a hydrophilic front layer unit coated on the front major face of the support (to be contacted with the sole intensifying screen when exposed to "soft" X-rays, generated from a device with a tube voltage of 20 kV to 40 kV, as is typical for mammographic applications) wherein the front layer unit is capable of reaching a maximum density of more than 3.00, and even more preferably more than 3.5, after processing and wherein sensitivity (speed), measured at a density of 0.50 above fog, is higher for the front layer unit than for the back layer unit in an amount of from 0.70 up to 1.70 log (Exposure) and in a more preferred embodiment the back layer unit has a speed ranging from 1.00 log E to 1.50 log E slower than the front layer unit.

So according to a preferred embodiment the front layer is coated with cubic silver halide emulsion crystals in an amount, expressed as equivalent amount of silver nitrate, of less than 8.5 $g/m^2$ and more preferably in the range from 6.0 to 7.0 $g/m^2$, but always more than 4.0 $g/m^2$. The radiation-sensitive cubic silver halide emulsion grains therein have an average grain size in the range of from 0.45 $\mu$m up to 0.85 $\mu$m. Coating amounts of hardenable hydrophilic colloid, composing the front layer unit are, in a preferred embodiment, limited to less than 5.0 $g/m^2$ and, more preferably to less than 4.0 $g/m^2$, and coating amounts of non-hardenable hydrophilic colloid are limited to less than 60 weight % thereof; in order to provide the desired sensitometric and drying properties within the short running time (within 120 seconds, and more preferably less than 90 seconds) of the processing cycle as will be described hereinafter.

In order to provide the desired speed difference between the front layer unit and the back layer unit, the said back layer unit is coated with radiation-sensitive cubic silver halide grains accounting for less than 40% (but not less than ⅕) of the total radiation-sensitive silver halide present in the film, preferably in an amount of not more than 3 $g/m^2$, expressed as equivalent amount of silver nitrate, wherein said cubic grains having an average grain size in the range from 0.40 up to 0.60 $\mu$m. The hydrophilic backing layer unit coated on the back major face of the support further contains hardenable hydrophilic colloid limited to less than 4.0 $g/m^2$, (more preferably in the range from 2.0 up to 3.0 $g/m^2$) and non-hardenabe hydrophilic colloid limited to less than 60 weight % thereof.

A total amount of silver halide coated in the material (sum of coating amounts at both sides for both—front and back—layer units), expressed as equivalent amount of silver nitrate again, should be in the range from 6.0 up to 10.0 $g/m^2$.

In favor of attaining that speed difference the image-forming portion in the material according to the present invention is, as a consequence of its composition, as disclosed hereinbefore, further comprised of a hydrophilic front layer unit coated on the front major face of the support capable of absorbing up to at least 60%, and more preferably even more than 70%, of the exposing radiation.

The cubic grains in the back layer unit, exhibiting a speed that ranges from 0.3 log E to 1.0 log E slower than in the front layer unit, provide facilitating visualization of anatomical features in the region of the skin-line. Said "E" stands for "Exposure" and speed (sensitivity) is measured at a density of 1.0 above fog for the front as well as for the back layer unit.

In a preferred embodiment according to the present invention, hardenable hydrophilic colloid in the whole back layer unit should be limited to less than or at most 3.0 $g/m^2$, and should, more preferably, be situated in the range from 2.0 to 2.5 $g/m^2$, whereas in the whole front layer unit it should be limited to less than 4.0 $g/m^2$, more preferably be situated in the range from 3.5 to 3.9 $g/m^2$.

In the back layer unit the non-hardenabe hydrophilic colloid, the presence of which is preferably limited to the light-sensitive emulsion layer thereof, should be limited to less than 10 wt %, but more than 5 wt %, versus the total amount of hardenable hydrophilic colloid present in the whole back layer unit.

Opposite thereto in the front layer unit the non-hardenabe hydrophilic colloid is present in the light-sensitive emulsion layer thereof in an amount of more than 50 wt % and even up to 60 wt %, versus the amount of hardenable hydrophilic colloid present in the light-sensitive layer, which means that in the whole front layer unit the said non-hardenable hydrophilic colloid is present in an amount of about 30 wt % (preferably in the range from 25 up to 35 wt %).

With respect to the terminology "whole back layer unit" it is understood that, according to the present invention, besides the subbed support a density providing layer is present, situated farther from the said support, and adjacent thereto the emulsion layer is present, further covered by an outermost protective antistress layer as a topcoat layer, whereas the terminology "whole front layer unit" is indicative, according to the present invention, besides the subbed support, for a light-sensitive emulsion layer adjacent to the said subbed support, and wherein said emulsion layer is covered by an outermost protective antistress layer as a topcoat layer, wherein this protective layer must be hardened to an extent in order to avoid scratches due to contact made with the intensifying screen during exposure.

With respect to the subbing layers coated directly on the thus provide subbed support, it is clear that these layers are coated (preferably during stretching the polyester in order to get the support of the desired thickness) in order to improve the adhesion of the radiation-sensitive emulsion layer of the front layer unit and the non-radiation sensitive dye containing layer of the back layer unit to the support.

In addition an undercoat layer between the emulsion and subbing layer(s) and a protective layer on top of the emulsion layer(s) is present. Additional non light-sensitive intermediate layers are optional.

The layer arrangements of the whole front and back layer units described hereinbefore should further be constructed in such a way that after processing (inclusive for the drying step) no curl of the processed film material occurs, as examination of the image would become more problematic. A solution therefore has been described in EP-A 1 148 379.

In that invention a single-side coated light-sensitive silver halide photographic film material has been described, comprising, on one side of a subbed support, one or more light-sensitive silver halide emulsion layer(s) overcoated with an outermost protective layer; said emulsion layer(s) having silver halide grains dispersed in binder, wherein said silver halide is coated in a total amount, expressed as an equivalent amount of silver nitrate of more than 5 g per $m^2$, a latex polymer present in an amount of less than 30% by weight versus said binder, and, at the other side of said support, a backing layer, covered with a protective outermost layer, characterized in that at least said backing layer is provided in at least one layer thereof, besides a cross-linked or cross-linkable first binder, with an organic component as a second binder, wherein said organic component is free from cross-linking upon reaction with a hardener and wherein said organic component is a polymer selected from the group consisting of dextran having a molecular weight of not more than 20000 and polyacrylamide having a molecular weight not more than 20000. Said organic component free from cross-linking upon reaction with a hardener is present therein in an amount of more than 50% by weight of a total binder amount calculated as sum of said first and second binder.

In the present invention use is thus made again of a first cross-linkable binder, called hardenable hydrophilic colloid in the present invention and present in amounts in the front layer unit and in the back layer unit as disclosed hereinbefore, besides a second binder, called herein "non-hardenable hydrophilic colloid", being a polymer selected from the group consisting of dextran having an average molecular weight from 1000 up to 100000, polyacrylamide having an average molecular weight from 1000 up to 100000, polyvinyl-pyrrolidone, polyvinyl alcohol and gelatin of the type which is free from cross-linking upon reaction with a hardener, more preferably a polymer selected from the group consisting of dextran having a molecular weight of not more than 20000 and polyacrylamide having a molecular weight not more than 20000. Amounts at both sides of the support are differing from those disclosed in the cited EP-Application as an equilibrium in order to prevent the processed material from curling had to be sought, due to the presence of light-sensitive emulsion layers at both sides of that support now, moreover being complicated by the presence of coating amounts of silver (expressed as equivalent amount of silver nitrate) at both sides, clearly differing from each other. Apart from differing amounts of coated silver halide, differing total amounts of hydrophilic polymer at both sides of the support are present in that the topcoat layer of the front layer unit is coated from an amount of gelatin of about 1.0 up to 1.2 $g/m^2$, corresponding with a coating amount twice as high as coated in the topcoat layer of the back layer unit, and wherein, even when the "density providing layer" in the back layer unit contains about 0.5 $g/m^2$ of gelatin amounts of gelatin in the back layer unit are not exceeding 60 wt % of the total amount of gelatin coated in the whole front layer unit.

Therefore amounts of hardener should be added to the respective layer units in order to get a perfect balance for the material when leaving the processor as a dried film material bearing the image to be examined. As a consequence amounts of water absorption before processing should be different at the front layer unit side versus at the back layer unit side due to the required differences in hardening degrees, but should become about equal after processing: as dextran is a non-hardenable polymer binder, present in higher amounts in the emulsion layer(s) of the front layer unit—more than 0.5 $g/m^2$, more preferably more than 1.0 $g/m^2$ and even more preferably more than 1.5 $g/m^2$) in an amount of about 10 times the amounts in the emulsion layer(s) of the back layer unit, the highest amounts will leave the photographic material from the front layer unit during processing, and more particularly during the rinsing step, the better for dextran having a lower molecular weight (M.W. of 10000 even being more preferred than a M.W. of 20000; differentiation in M.W. in front and back layer unit moreover leaving further degrees of freedom in optimizing the layer built-up of the material of the present invention). After the drying step a processed material without ennoying curl properties is thus attained thanks to a suitable balance of hydrophilic colloid gelatin binder in front and back layer unit.

As a hardenable hydrophilic colloid binder of the layers, gelatin is used as a preferred polymer binder material, which can be forehardened with appropriate hardening agents such as those of the epoxide type, those of the ethylenimine type, those of the vinylsulfone type, e.g. 1,3-vinylsulphonyl-2-propanol or di-(vinylsulphonyl)-methane, vinylsulphonyl-ether compounds, vinylsulphonyl compounds having soluble groups, chromium salts like e.g. chromium acetate and chromium alum, aldehydes as e.g. formaldehyde, glyoxal, and glutaraldehyde, N-methylol compounds as e.g. methylol-urea and methyloldimethylhydantoin, dioxan derivatives e.g. 2,3-dihydroxy-dioxan, active vinyl compounds e.g. 1,3,5-triacryloylhexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with onium compounds as disclosed in EP-A 0 408 143.

Topcoat layers present as outermost layers at both sides of the material according to the present invention have a protective function and are coated from hydrophilic colloid in an amount of from about 1.1 $g/m^2$ and 0.5 $g/m^2$ in the front and in the back layer unit respectively, wherein those amounts are not to be considered as being limitative as amounts differing therefrom may be applied.

According to the present invention a density providing layer is present as an additional layer in the back layer unit: situated in a layer farther from the support than the emulsion layer(s), it represents a layer containing a dye in an amount in order to provide a density of at most 0.40 (about 0.40 in green light; about 0.30 in white light) before, and less than 0.10 after processing, due to decolorization of said dye in an alkaline developer. In a further embodiment the dye exhibits a half peak absorption bandwidth over the spectral region of peak emission by the intensifying screen. Accordingly preferred dyes suitable for use in the density providing layer have been described in EP-A's 0 489 973, 0 586 748, 0 587 229, 0 587 230, 0 656 401, 0 786 497 and 0 781 816, as well in the US-A's corresponding therewith. Especially preferred is the dye according to the formula (I) hereinafter, the preparation method of which has been described in U.S. Pat. No. 5,344,749.

(I)

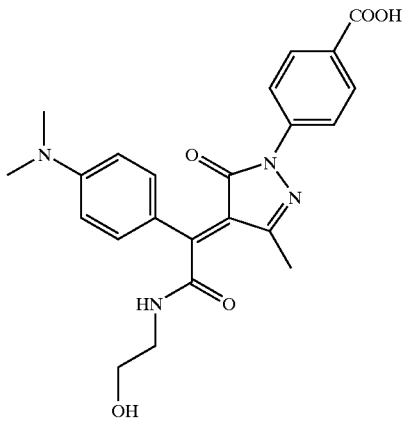

Methods in which dye dispersions can be prepared have been described in EP-A's 0 549 486, 0 602 428, 0 724 191, 0 756 201, 0 762 193 and 0 762 194. Examples of typical so-called ultrafine (less than 1 $\mu$m) "solid particle dispersions" and the method of preparing them can be found in EP-A's 0 299 435, 0 323 729, 0 351 593, 0 387 923, 0 524 498, and in U.S. Pat. No. 4,988,611; without however being limited thereto. Said dyes can also be added in the form of a solid silica particle dispersion as disclosed in EP-A 0 569 074. Still another technique to obtain ultra fine dye dispersions consists in acidifying a slightly alkaline coating composition "in situ" just before coating it onto the supporting layer. Further useful information about dyes having decolorizing characteristics in alkaline processing solutions can be found in Research Disclosure, Item 38957, Chapter VIII. Presence of such dye(s) in adapted amounts is not only recommended to adjust the sensitivity of the different emulsion layers and eventually the required contrast, but also in order to reduce scattering of exposure radiation and thus to enhance sharpness.

Apart from the said dye or dyes providing a density of at most 0.40 in the back layer unit, the radiographic material according to the present invention has a spectral sensitivity maximum by the adsorption of spectral sensitizers disclosed hereinbefore, absorbing light from the phosphors prompt emitting light in the wavelength range from 540 to 555 nm after having been irradiated with X-rays, said maximum corresponding with an exposure amount from 5 to 130 $\mu$J per $m^2$ required in order to obtain an optical density of Dmin+1.0 after processing.

Other dyes, which per se do not have any spectral sensitization activity, or certain other compounds, which do not substantially absorb visible radiation, can have a supersensitization effect when they are incorporated together with spectral sensitizing agents into the emulsion. Suitable supersensitizers are e.g. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/formaldehyde condensation products as described e.g. in U.S. Pat. No. 3,743,510 as well as cadmium salts, although nowadays to be avoided, due to ecological considerations, and azaindene compounds.

The silver halide emulsions suitable for use in hydrophilic layers of the film material according to the present invention may also comprise compounds preventing the formation of a high minimum density or stabilizing the photographic properties during the production or storage of photographic materials or during the photographic treatment thereof. Many known compounds may be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercaptotetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738 and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds which can be used as fog-inhibiting compounds are those described in Research Disclosure No. 17643 (1978), Chapter VI; in Research Disclosure, Item 38957, Chapter VII and in Item 18431, Chapter II. These fog-inhibiting agents or stabilizers may be added to the silver halide emulsion prior to, during, or after the ripening thereof and mixtures of two or more of these compounds can be used.

The photographic material according to the present invention may further comprise various kinds of surface-active agents in the light-sensitive emulsion layer(s) or in at least one other hydrophilic colloid layer. Suitable surface-active agents include non-ionic agents such as saponins, alkylene oxides, e.g., polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, siliconepolyethylene oxide adducts, glycidol derivatives, fatty acid esters of polyhydric alcohols and alkyl esters of saccharides, anionic agents comprising an acid group such as a carboxyl, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes, e.g. as coating aids, as compounds preventing electric charges, as compounds improving film transport in automatic film handling equipment, as compounds facilitating dispersive emulsification, as compounds preventing or reducing adhesion, and as compounds improving photographic properties such as higher contrast, sensitisation and development acceleration.

Especially when rapid processing conditions are important, development acceleration may be useful, which can be accomplished with the aid of various compounds, preferably polyoxyalkylene derivatives having a molecular weight of at least 400 such as those described in e.g. U.S. Pat. Nos 3,038,805; 4,038,075 and 4,292,400. Especially preferred developing accelerators are recurrent thioether groups containing polyoxyethylenes as described in DE 2,360,878, EP-A's 0,634,688 and 0,674,215, which are incorporated herein by reference. The same or different or a mixture of different developing accelerators may be added to at least one of the hydrophilic layers at the emulsion side. It may be advantageous to partially substitute the hydrophilic colloid binder, preferably gelatin, of the light-sensitive silver halide emulsion layer or of an hydrophilic colloid layer in water-permeable relationship therewith by suitable amounts of dextran or dextran derivatives to improve the covering power of the silver image formed and to provide a higher resistance to abrasion in wet condition.

The photographic material of the present invention may further comprise various other additives such as compounds improving the dimensional stability of the photographic material, UV-absorbers, spacing agents, lubricants, plasticizers, antistatic agents, etc. as those described in Research Disclosure, Item 38957, Chapter IX, particularly referring to coating physical property modifying addenda, as coating aids (A), plasticizers and lubricants (B), antistatic agents (C), and matting agents (D). Suitable additives for improving the dimensional stability are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylo-nitriles, olefins and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 μm. Spacing agents can be soluble or insoluble in alkali. Alkali-insoluble spacing agents usually remain permanently in the photographic material, whereas alkali-soluble spacing agents usually are removed in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708. Compounds which can be used as a plasticizer for the hydrophilic colloid layers are acetamide or polyols such as trimethylolpropane, pentanediol, butanediol, ethylene glycol and glycerine. Further, a polymer latex is preferably incorporated into the hydrophilic colloid layer for the purpose of improving the anti-pressure properties, e.g. a homopolymer of acrylic acid alkyl ester or a copolymer thereof with acrylic acid, a copolymer of styrene and butadiene, and a homopolymer or copolymer consisting of monomers having an active methylene group.

The photographic material may comprise an antistatic layer to avoid static discharges during coating, processing and other handling of the material. Such antistatic layer may be an outermost coating like the protective layer or an afterlayer or a stratum of one or more antistatic agents or a coating applied directly to the film support or other support and overcoated with a barrier or gelatin layer. Antistatic compounds suitable for use in such layers are e.g. vanadium pentoxide soles, tin oxide soles or conductive polymers such as polyethylene oxides or a polymer latex;, polythiopene (and more particularly PEDT) and the like.

Non-neutral silver image colors obtained after processing, due to the color of the silver thus formed, can be corrected by increasing the optical density in the red region of the visible spectrum by adding suitable dyes to the support or any coated layer. This non-image wise color correction method has been disclosed in references as e.g. JP-A's 03-100645, 01-029838, 01-312536, 03-103846, 03-094249, 03-255435, 61-285445; issued EP-A 0 271 309 and U.S. Pat. No. 4,861,702. This method however may result in an excessive base+fog density of the photographic material and therefore, an alternative way consists in an image-wise color correction by using color-forming developers, which are blue colored in their oxidized form. Examples thereof have been summarized in JP-A's 03-153234, 03-154043 and 03-154046. In JP-A's 03-156447 and 03-157645 the adsorption of a blue colored dye as a function of exposure has further been disclosed.

According to the present invention the processing of the exposed material includes the steps of developing, fixing and drying, is performed within 120 seconds or less and more preferably within 90 seconds or less. An important advantage of the dual- or double-side coated radiographic elements for soft tissue imaging is that they are much better suited for rapid processing applications than radiographic elements containing a single emulsion layer unit. This suitability for rapid processing is particularly due to the fact that high amounts of silver are not restricted to presence in only one radiation-sensitive emulsion layer and to the fact that, opposite to duplitized films as for chest imaging in radiology, low cross-over can only be attained the presence of two antihalation layers, interposed between the support and each emulsion layer unit. This allows the amount of hydrophilic colloid coated on each side of the support to be decreased further if compared with amount spresent in the said duplitized films. Rapid processing in mammographic applications, more preferably related with hardener-free processing solutions although not limited thereto, has been described in EP-A's 0 610 609, 0 712 036 and 0 874 275 and is perfectly suitable for use in the present application.

After image-wise exposure by light emitted by the intensifying screen and processing the image thus obtained, an average contrast or gradient in the range from 3.0 up to 4.5, measured over a density above fog in the range of from 0.25 to 2.00, is thus attained, wherein said image-forming portion is comprised of layer units permeable for aqueous processing solutions, said layer units being a hydrophilic front layer unit coated on the front major face of the support wherein the front layer unit is capable of reaching a maximum density of more than 3.00 and a hydrophilic back layer unit coated on the back major face of the support, wherein sensitivity (speed), measured at a density of 0.50 above fog, is higher for the front layer unit than for the back layer unit in an amount of from 0.70 up to 1.70 log (Exposure), thanks to the presence in both, the front layer unit and the back layer unit, of the presence of one or more light-sensitive silver halide emulsion layer(s) coated with emulsion crystals, essentially having a cubic crystal habit.

According to the present invention a radiological method for obtaining a diagnostic image for mammography is provided, comprising the steps of mounting a film-screen system by bringing a photographic material as disclosed herein into contact with a radiographic X-ray conversion screen; and processing said photographic material in a total dry-to-dry processing time of from 38 seconds up to less than 120 seconds, and, more preferably, in a dry-to-dry processing time of from 45 up to 90 seconds. Sensitometric curves of processed film materials are known to show the plot of optical density (D) as a function of relative logarithmic exposure (logE). Important characteristics of mammographic film materials in particular, besides the preferably low fog and high speed (defined as the log E(xposure) at which the optical density is equal to minimum density Dmin+1.0) and contrast are the skin line point (SL) being defined herein as the point of the sensitometric curve where log E equals the "Speed Point"+0.8.

A practical mammogram is normally obtained by subjecting a film-screen system to X-ray exposure. In diagnostic image formation any commercially available X-ray generating device may be used, providing an exposure to soft X-rays with a tube voltage of 20 to 40 kV. A preferred luminescent phosphor coated in the X-ray conversion screen is Gd2O2S:Tb, which emits green light in the wavelength range from 540 tot 555 nm. Said phosphor and its use in intensifying screens have been described extensively in patent literature, e.g. in U.S. Pat. Nos. 3,872,309; 4,130,429; 4,912,333; 4,925,594; 4,994,355; 5,021,327; 5,107,125 and 5,259,016 and in GB-A 1,489,398. The thickness of the phosphor layer depends on the amount of coated phosphor required in order to obtain the desired screen speed. A preferred intensifying screen used in combination with the film material according to this invention is characterized by a phosphor coating weight of at least 45 mg/cm$^2$ and a phosphor to binder ratio of at least 97:3 as described in EP-A 0 712 036.

EXAMPLES

While the present invention will hereinafter be illustrated by working examples representing preferred embodiments thereof, it will be understood that it is not intended to limit the invention to those embodiments.

Layer arrangement of the coated Film Materials:

| Side | Film A (Comparative I) | Film B (Invention) | Film C (Comparative II) |
|---|---|---|---|
| Front Layer Unit | Protective layer I<br>Emulsion layer I (cubes)<br>Emulsion layer II (cubes)<br>Support* | Protective layer I<br>Emulsion layer I (cubes)<br>Support* | Protective layer I<br>Emulsion layer I (cubes)<br>Support* |
| Back Layer Unit | Antihalation layer I<br>Protective layer II | Emulsion layer II (cubes)<br>Antihalation layer II<br>Protective layer I | Emulsion layer III (tabs)<br>Antihalation layer II<br>Protective layer I |

*thickness: 175 μm blue tinted polyester support

Detailed Description of the Layer Compositions

Protective layer I (amounts in g/m$^2$):

| | |
|---|---|
| gelatin: | 1.1 |
| polymethyl methacrylate spacing agent (average particle size: 3 μm) | 0.018 |
| chromium acetate: | 0.005 |
| 4-hydroxy-6-methyl-1,3,3a,7-tetraazaindene: | 0.082 |
| $CF_3(CF_2)_6$ COOH.$NH_3$: | 0.007 |
| $CF_3(CF_2)_6$ CONH $(CH_2CH_2O)_{17-20}$: | 0.019 |
| Phenol: | 0.003 |
| Mobilcer Q (a paraffin wax, trade name product from MOBIL OIL): | 0.025 |
| formaldehyde (added just before coating): | 0.18 |

Protective layer II (amounts in g/m$^2$):

| | |
|---|---|
| gelatin: | 0.56 |
| $CF_3(CF_2)_6$COOH.$NH_3$: | 0.002 |
| glyoxal: | 0.17 |
| polymethyl metacrylate particles (av. part. size: 7 μm): | 0.023 |

Emulsion layer I (amounts in g/m$^2$):

| | |
|---|---|
| AgBr(I) emulsion having cubic grains* (1 mole % AgI/99 mole % AgBr) in weight amount expressed as equivalent amount of $AgNO_3$ | 6.4 |
| gelatin: | 2.56 |
| 5,5'-dichloro-3,3'-bis(n-propyl-4-sulphonate)-ethylbenzoxacarbocyanine (anhydrous triethylammonium salt) | 0.014 |
| 4-hydroxy-6-methyl-1,3,3a,7-tetraazaindene | 0.029 |
| sorbitol | 0.45 |
| polyethylacrylate, latex as a plasticizer | 0.45 |
| resorcinol | 0.10 |
| potassium bromide | 0.007 |
| dextran (M.W. = 10000) | 1.50 |

*cubic crystals having mean grain size (edge length) of 0.70 μm (average diameter, calculated from spheres having equivalent volume; precipitation and chemical ripening described below)

Emulsion layer II (amounts in g/m$^2$):

| | |
|---|---|
| AgBr(I) emulsion having cubic grains** (1 mole % AgI/99 mole % AgBr) in weight amount expressed as equivalent amount of $AgNO_3$ | 2.4 |
| Gelatin | 1.2 |
| 5,5'-dichloro-3,3'-bis(n-propyl-4-sulphonate) ethylbenzoxacarbocyanine anhydrous triethylammonium salt | 0.003 |
| 4-hydroxy-6-methyl-1,3,3a,7-tetraazaindene | 0.001 |
| sorbitol | 0.17 |
| polyethylacrylate, latex as a plasticizer | 0.17 |
| resorcinol | 0.04 |
| potassium bromide | 0.002 |
| dextran (M.W. = 10000) | 0.21 |

**mixture of cubic crystals (55 wt % having average grain size of 0.57 μm and 45 wt % having average grain size of 0.38 μm (average diameters, calculated from spheres having equivalent volume; precipitation and chemical ripening described below)

Emulsion layer III (amounts in g/m$^2$):

| | |
|---|---|
| AgBr(I) emulsion having tabular grains*** (1 mole % AgI/99 mole % AgBr); expressed as equivalent amount of $AgNO_3$ | 2.4 |
| Gelatin | 1.2 |
| 5,5'-dichloro-3,3'-bis(n-propyl-4-sulphonate)-ethylbenzoxacarbocyanine anhydrous triethylammonium salt | 0.01 |
| 4-hydroxy-6-methyl-1,3,3a,7-tetraazaindene | 0.004 |
| sorbitol | 0.17 |
| polyethylacrylate latex (as a plasticizer) | 0.17 |
| resorcinol | 0.04 |
| potassium bromide | 0.002 |
| dextran (M.W. = 10000) | 0.21 |

***tabular crystals having an average diameter of 0.70 μm and an average grain thickness of 0.10 μm (calculated as equivalent circular diameter, obtained from shadowed electron microscopic replicas, as well as thickness of the grains; precipitation and chemical ripening described below)

Antihalation layer I (amounts in g/m$^2$):

| | |
|---|---|
| gelatin | 3.19 |
| dye I | 0.08 |

-continued

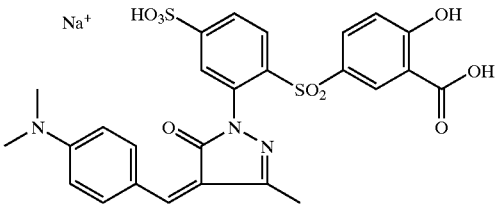

dye I

| | |
|---|---|
| silica particles (average diameter 7–10 nm): | 1.13 |
| Antihalation layer II (amounts expressed in g/m$^2$): | |
| gelatin | 1.4 |
| dye II (see dye according to the formula (I) in the detailed description in form of a dispersion having average particle size of 1 $\mu$m) being decolorized in the processing solution: | 0.190 |

Emulsion preparation of emulsions having cubic/tabular crystals respectively:

Preparation of AgBr(I) Cubic Grain Emulsion (0.70 $\mu$m)

Precipitation scheme:

To 1 l of a solution, containing 15 g of methionine and 50 g of gelatin, adjusted to a pH of 5.8, were added, at 60° C., by double jet addition, a 2.94 M solution of $AgNO_3$ at a constant flow rate of 5.7 ml/min during 5 minutes and a solution of a mixture of 2.91 M of KBr and 0.03 M of KI at a flow rate controlled in order to maintain pAg constant at 7.8.

Then the flow rate of the $AgNO_3$ solution was increased linearly up to 21 ml/min during 72 minutes and 46 seconds. Cubic grains thus prepared having as a composition 99 mole % AgBr and 1 mole % AgI, based on silver, showed an average grain size (edge length, calculated from equivalent sphere volumes) of 0.70 $\mu$m.

Chemical ripening:

At a pH of 6.0, optimized amounts of sodium thiosulphate, chloro auric acid, ammonium thiocyanate, sodium toluene thiosulphonate and sodium sulphite were added in order to provide the best available fog/speed ratio.

Preparation of AgBr(I) Cubic Grain Emulsion (0.57 $\mu$m)

Precipitation scheme:

Same as the scheme in order to prepare the cubic grain emulsion of 0.70 $\mu$m described hereinbefore, but with a flow rate of 10.6 instead of 5.7 ml/min during the first 5 minutes.

Chemical ripening conditions:

At a pH of 6.0, optimized amounts of sodium thiosulphate, chloro auric acid, ammonium thiocyanate, sodium toluene thiosulphonate and sodium sulphite were added in order to provide the best available fog/speed ratio.

Preparation of AgBr(I) Cubic Grain Emulsion (0.38 $\mu$m)

Precipitation scheme:

Same as the scheme in order to prepare the cubic grain emulsion of 0.70 $\mu$m described hereinbefore, but a flow rate of 35.6 instead of 5.7 ml/min during the first 5 minutes.

Chemical ripening conditions:

At a pH of 6.0, optimized amounts of sodium thiosulphate, chloro auric acid, ammonium thiocyanate, sodium toluene thiosulphonate and sodium sulphite were added in order to provide the best available fog/speed ratio.

Preparation of AgBr(I) Tabular Grain Emulsion (Equivalent Volume Diameter of 0.53 $\mu$m, Average Grain Thickness 0.09 $\mu$m)

Precipitation scheme:

In a reaction vessel a solution was prepared of 6.9 g of oxidized gelatin in 3 l of demineralized water at 51° C., adjusted to a pH of 2.5 by adding $H_2SO_4$, and said solution was stirred at a rate of 600 r.p.m. To said solution were added by a double jet method aqueous solutions of 0.98 M AgNO3 (hereinafter referred to as A1) and 0.98 M KBr (hereinafter referred to as B1): 25 ml of A1 and 25 ml of B1 were added in a time interval of 30 seconds. When the addition was completed, the temperature was increased up to 70° C. over a period of 30 minutes: UAg was controlled (expressed in mV versus a Ag/AgCl(sat.) reference electrode and should be in the range from 44.5±5 mV at a temperature of 70° C.±1° C. 1 minute later pH was set to a value of 5.0±0.3 and immediately thereafter a solution of 50 g of inert gelatin in 500 ml of demineralized water of 70° C. was added. 3 minutes later B1 was added at a rate of 7.06 ml/min. during 120 seconds, while simultaneously adding by double jet A1 at a rate of 7.5 ml/min. In a further double jet addition A1 and B1 were added during 2822 seconds at a linearly increasing rate going from 7.0 up to 21.11 ml/min. for A1 and from 7.06 up to 21.29 ml/min. in order to maintain a constant UAg potential of +40 mV in the reaction vessel. After 5 minutes A1 and B1 were simultaneously added by double-jet addition during 60 seconds at a rate of 10.0 and 10.04 ml/min. respectively whereby the UAg value was held at a constant value of 50 mV while increasing the flow rate up to 46.49 ml/min. and 46.69 ml/min. respectively over a total time period of 81 min. and 5 seconds.

After that double-jet addition time period, an amount of an emulsion having ultrafine (ca. 0.040 $\mu$m) 100% AgI crystals, dissolved in 20 g of demineralized water at 40° C., was added to the reaction vessel in order to get a total AgI content at the end of precipitation of 0.1 mole % based on precipitated silver halide.

Chemical ripening conditions:

At a pH of 6.0, optimized amounts of sodium thiosulphate, chloro auric acid, ammonium thiocyanate and sodium sulphite were added in order to provide the best available fog/speed ratio.

Exposure and processing conditions:

Samples of Film Materials A, B and C, the layer arrangement of which has been given hereinbefore, were identically exposed from the front-side with green light (filter Corning 4010) during 2.0 seconds, making use of a continuous wedge.

The samples were processed in a CURIX 530®, tradename of Agfa-Gevaert N.V., automatic processing machine.

Processing sequence and conditions in the said CURIX 530® processing machine were following (expressed in seconds(sec.), temperature (in °C.) added thereto:

| | |
|---|---|
| loading | 3.4 sec. |
| developing | 23.4 sec./35° C. in developer |
| cross-over | 3.8 sec. |
| fixing | 15.7 sec./35° C. in fixer G334 ® |
| cross-over | 3.8 sec. |
| rinsing | 15.7 sec./20° C. |
| drying | 32.2 sec. (cross-over time included) |
| total time | 98.0 sec. |

Samples of the film materials were processed in an "active" developer and in a "weak" developer, the weak developer being a model for less optimal development conditions:

1) The "active" developer: G138®: a glutaraldehyde containing hydroquinone/1-phenyl-3-pyrazolidine-1-one ("phenidone") developer marketed by Agfa-Gevaert N.V.
2) Composition of the "weak" developer in grams per liter, ready-for-use:

| | |
|---|---|
| Potassium sulphite | 23.0 |
| Sodium sulphite | 27.0 |
| Boric acid | 6.80 |
| EDTA (tetra sodium salt) | 1.40 |
| HEDP | 0.62 |
| Hydroquinone | 16.0 |
| Potassium hydroxide | 17.5 |
| Phenidone | 0.96 |
| Nitro-6-Benzimidazole | 0.06 |
| Methyl benzotriazole | 0.048 |
| Acetic acid | 9.54 |
| Diethyleneglycole | 14.5 |
| Glutardialdehyde | 3.50 |
| Potassium metabisulphite | 6.00 |
| Potassium bromide | 3.20 |
| Potassium iodide | 0.008 |

Determination of fog, contrast(gradation) and speed (sensitivity):

After exposure and procesing under the above described circumstances the optical density as a function of exposure dose was measured and fog, speed and contrast were determined as follows:

(i) Fog "F": density "D" at a non-exposed part of the sample, minus density of the undercoat layer.
(ii) Speed "S": log E(xposure) value at density value of 1.4+Fog.
(iii) Average contrast "GG": determined as 1.75/((log E at density D=2.00+F)−(log E at density D=0.25+F))
(iv) Contrast "GGSKIN": determined at the higher density part of the sensitometric curve determined as:

$$(\text{density } D=(S+1.00\log E)-\text{density } D=(S+0.72\log E))/0.28.$$

Results:

Table I shows values of fog "F", speed "S", contrasts "GG" and "GGSKIN" after processing samples of film materials A (comparative), B (inventive) and C (comparative) in the active (AD) and weak developer (WD) respectively.

Differences between the results in both developing processing conditions thus obtained were calculated and given in the Table I as Δ (AD−WD).

Figures of fog F have been multiplied by a factor of 1000; all other figures have been multiplied by a factor of 100.

TABLE I

| Film | AD | | | | WD | | | | Δ (AD−WD) | | | |
|---|---|---|---|---|---|---|---|---|---|---|---|---|
| Mat1 | F | S | GG | GGSKIN | F | S | GG | GGSKIN | F | S | GG | GGSKIN |
| A | 205 | 138 | 390 | 161 | 198 | 146 | 370 | 141 | −7 | −8 | −20 | −20 |
| B | 211 | 141 | 380 | 153 | 203 | 147 | 350 | 148 | −8 | −7 | −30 | −5 |
| C | 208 | 145 | 369 | 156 | 201 | 151 | 352 | 128 | −7 | −6 | −17 | −28 |

As becomes clear from the data summarized in the Table I, all film materials show a loss in speed S and contrast (GG and GGSKIN) when processed in the weak developer WD, if compared with the active developer AD.

In the inventive Film Material B however, a clearly lower loss of contrast Δ GGSKIN in the high density region has been demonstrated, especially if compared with Film Material C containing tabular grains on the back-layer side of the material.

A photographic material having a large dynamic range and a high contrast, so that lesions deep in the glandular tissue are accurately detected, moreover clearly depicting thin, soft tissue such as the skin line, of the breast, has thus been provided.

Differences in speed (measured at a density of 0.5 above fog) between the front and back layer unit for inventive material B were calculated before and after washing off the front layer unit from the material B, processed in a G138® developer/G334® fixer combination after exposure to X-rays of the said material, being in intimate contact with an intensifying mammographic screen Mamoray HD® (trademarketed product from Agfa-Gevaert N.V., Mortsel, Belgium, at the front layer side thereof: a difference of 1.30 log E (Exposure) was calculated.

The film allows rapid processing by good developability within a cycle of at most 120 seconds and provides high levels of image sharpness and a good image tone in processing cycles having differing activities, thereby showing good archivability and drying capacity.

Having described in detail preferred embodiments it is understood that the invention is not limited thereto as will become apparent from the claims as formulated hereinafter.

What we claim is:

1. A radiographic film material for recording medical diagnostic images of soft tissue through exposure to light, emitted by a single intensifying screen, after having been subjecting to exposure with X-rays, emitted from an X-ray generating device with a tube voltage of 20 kV to 40 kV, and processing, including development, fixing and drying, within a time of 120 seconds or less, wherein said film is comprised of a transparent film support;

front and back major faces and an image-forming portion for providing, when imagewise exposed by light emitted by said intensifying screen and processed, an average contrast or gradient in the range from 3.0 up to 4.5, measured over a density above fog in the range of from 0.25 to 2.00, and wherein said image-forming portion is comprised of layer units permeable for aqueous processing solutions, said layer units being a hydrophilic front layer unit coated on the said front major face of the support wherein the front layer unit is capable of reaching a maximum density of more than 3.00;

a hydrophilic back layer unit coated on the said back major face of the support;

wherein sensitivity (speed), measured at a density of 0.50 above fog, is higher for the front layer unit than for the back layer unit in an amount of from 0.70 up to 1.70 log (Exposure);

characterized in that both the front layer unit and the back layer unit have one or more light-sensitive silver halide emulsion layer(s) coated with emulsion crystals, essentially having a cubic crystal habit.

2. Material according to claim 1, wherein the said hydrophilic front layer unit coated on the front major face of the support is capable of absorbing up to at least 60% of the exposing radiation and contains (a) hardenable hydrophilic colloid limited to less than 5.0 $g/m^2$, and non-hardenabe hydrophilic colloid limited to less than 60 weight % thereof;

(b) radiation-sensitive cubic silver halide grains having an average grain size in the range of from 0.45 $\mu$m up to 0.85 $\mu$m, the coating amount of the silver halide, expressed as equivalent amount of silver nitrate, being limited to less than 8.5 $g/m^2$.

3. Material according to claim 1, wherein the said hydrophilic backing layer unit coated on the back major face of the support contains (a) hardenable hydrophilic colloid limited to less than 4.0 $g/m^2$, and non-hardenabe hydrophilic colloid limited to less than 60 weight % thereof;

(b) radiation-sensitive cubic silver halide grains accounting for less than 40% of the total radiation-sensitive silver halide present in the film, said cubic grains having an average grain size in the range from 0.40 up to 0.60 $\mu$m.

4. Material according to claim 1, wherein a total amount of silver, expressed as silver nitrate, is present in an amount of from 6.0 up to 10.0 $g/m^2$.

5. Material according to claim 1, wherein the said back layer unit is provided with a density providing layer, situated farther from the support than the image-forming layer and wherein said density providing layer contains a dye in an amount in order to provide a density of at most 0.40 before, and less than 0.10 after processing.

6. Material according to claim 1, wherein said dye exhibits a half peak absorption bandwidth over the spectral region of peak emission by the intensifying screen.

7. Material according to claim 1, wherein the silver halide emulsions have a spectral sensitivity maximum in the wavelength range from 540 to 555 nm, said maximum corresponding to an exposure amount from 5 to 130 $\mu$J per $m^2$ required in order to obtain an optical density of Dmin+1.0 after processing.

8. Material according to claim 1, wherein the light-sensitive silver halide emulsion grains contain more than 50 mole % of silver bromide and less than 3 mole % of silver iodide, based on total molar silver amounts.

9. Material according to claim 8, wherein the light-sensitive silver halide emulsion grains are silver bromide grains or silver bromoiodide grains containing up to at most 1 mole % of silver iodide, based on total molar silver amounts.

10. A process of obtaining a medical diagnostic image of soft tissue comprising (a) mounting a radiographic film according to claim 1 adjacent to a single intensifying screen, (b) exposing the intensifying screen to an image pattern of X-radiation that has passed through the soft tissue to stimulate light emission by the intensifying screen that imagewise exposes the radiographic film, and (c) processing the radiographic film, including development, fixing and drying in less than 120 seconds.

* * * * *